United States Patent [19]

Murray

[11] 4,391,549

[45] Jul. 5, 1983

[54] EXPANSION JOINT INSERTER FOR CONTINUOUS CURB LAYING MACHINES

[75] Inventor: Jesse L. Murray, Yuma, Ariz.

[73] Assignee: The Tanner Companies, Phoenix, Ariz.

[21] Appl. No.: 197,468

[22] Filed: Oct. 16, 1980

[51] Int. Cl.[3] ..... E01C 23/02

[52] U.S. Cl. ..... 404/87; 404/98

[58] Field of Search ..... 404/87, 72, 89, 98, 404/105, 107; 29/235

[56] References Cited

U.S. PATENT DOCUMENTS

| | | | |
|---|---|---|---|
| 1,255,611 | 2/1918 | Innes | 404/107 X |
| 2,014,894 | 9/1935 | Heltzel | 404/74 |
| 2,045,256 | 6/1936 | Voigt | 404/87 |
| 2,276,542 | 3/1942 | Kovanda | 404/87 |
| 2,729,152 | 1/1956 | Carnes | 404/87 |
| 3,200,482 | 8/1965 | Brown | 29/235 |
| 3,246,390 | 4/1966 | Brown | 29/235 |
| 3,335,647 | 8/1967 | Thorp, Jr. | 404/87 |
| 3,427,938 | 2/1969 | Handy | 404/106 X |
| 3,473,450 | 10/1969 | Koch | 404/87 |
| 3,954,359 | 5/1976 | Larkin | 404/105 X |
| 4,049,359 | 9/1977 | Koch | 404/89 |
| 4,077,732 | 3/1978 | Koch | 404/87 |

FOREIGN PATENT DOCUMENTS

| | | | |
|---|---|---|---|
| 1953784 | 5/1971 | Fed. Rep. of Germany | 404/87 |

*Primary Examiner*—Nile C. Byers, Jr.

*Attorney, Agent, or Firm*—Charles E. Cates; Victor Myer

[57] ABSTRACT

The continuously extruding curb forming machine for roads, for example, may be equipped with a downwardly moving sharpened blade for use in the insertion of an expansion joint piece at appropriate intervals into the curb without stopping the operation of the machine while the expansion joint piece is inserted. The expansion joint piece may be well known felt material for this purpose and the inserting blade has a template attached thereto the surface of which conforms to the surface of the curb and thus to the surface of the expansion joint piece. As the blade moves into the partially cured concrete, the template forces the joint piece into the same concrete.

5 Claims, 8 Drawing Figures

EXPANSION JOINT INSERTER FOR CONTINUOUS CURB LAYING MACHINES

BACKGROUND OF THE INVENTION

This invention relates to continuous curb laying machines and methods therefor, more particularly, to such machines and methods wherein pieces of expansion joint material may be inserted at intervals into the cast green concrete curb without stopping the apparatus, and it is an object of the invention to provide improved apparatus and methods of this nature.

Continuous curb laying machines are known to the art. Concrete curbing is poured or cast, in a relatively stiff consistency so that it will retain its shape without significantly slumping after the slip form has passed over it. Typically, in the past, expansion joints have been formed in ribbons, or lines, of poured, or cast concrete curbing by hand operations. That is to say, after the concrete curbing has been poured, a workman with a trowel, or similar tool forms a slot in the concrete and inserts a piece of expansion joint material which is essentially a relatively stiff felt board. After the joint material has been inserted, the workman backfills the space on each side thereof with concrete from the original slot formation or from a supply that he may have at hand. In any event, the concrete on each side of the joint material must be smoothed and curved to fit the outline of the curbing in order for the job to appear finished and to have been correctly made. Not only in this process relatively tedious and expensive, but is it time consuming and it requires careful work.

It is also known to the prior art to have a machine for inserting an expansion joint into a road surface that has been cast, or poured, from concrete or the like. Because of the relatively wide expanse of road surfaces, machines for inserting expansion joint material or pieces have been of equal length, and thus, the apparatus for insertion of the joint material has been bulky and complicated. Schemes for supporting the expansion joint material during the insertion process have been complicated and have not lent themselves to utilization in curb forming apparatus because the curbing, ordinarily, has a shape different from straight or flat.

Certain expansion joint inserting machinery is known to the art. Reference may be made to U.S. Pat. Nos. 2,014,894 Heltzel, 3,200,482 Brown, 3,246,390 Brown, 3,335,647 Thorp, Jr., 3,473,450 Koch. In each of these patents road surfaces are poured first and a second machine is utilized to insert the expansion joint. In each case a slot or channel is first formed or the concrete previously treated at the place of insertion. Clearly these solutions are cumbersome and relatively inefficient when compared to the applicant's continuous apparatus and method.

SUMMARY OF THE INVENTION

It is an object of the invention to provide, in apparatus and methods for continuously laying curbing, an improved apparatus and method for inserting expansion joint material as part of a continuous process.

It is a further object of the invention to provide improved concrete curb forming machines including means for automatically inserting expansion joint material that will overcome the defects of the prior art.

In carrying out the invention according to one form, there is provided apparatus for inserting a piece of expansion joint material into a strip of cast material having a predetermined shape comprising a slip form of predetermined length and strip shape underneath which strip forming material is to be cast, a slot in the slip form, blade means adapted to move through the slot perpendicularly to the line of the slip form and through any green cast strip forming material, a template attached to one side of the blade for movement therewith, the template having a pushing surface whose outline conforms to the strip surface shape, and means for moving the blade into and out of the slot in the slip form.

In a preferred form of the invention, the template pushing surface outline would have the same image, or conforming, image shape of the strip curb or strip surface. The blade and template and the associated piece of expansion joint material may be forced, or rammed, into the green curbing strip by fluid pressure actuated pistons. Specifically, in some instances, air pressure may be used. The invention also contemplates the method of inserting pieces of expansion joint material into a continuously cast strip of concrete curbing which comprises the steps of providing a slip form of curb surface shape, continuously casting a concrete strip underneath the slip form, providing a slot forming blade to move vertically into the green concrete strip and providing a piece of expansion joint material on the downstream side of the blade on each movement thereof.

BRIEF DESCRIPTION OF THE DRAWINGS

For a more complete description of the invention reference may now be had to the accompanying drawings in which.

DESCRIPTION OF THE PREFERRED EMBODIMENT

Figure 1:
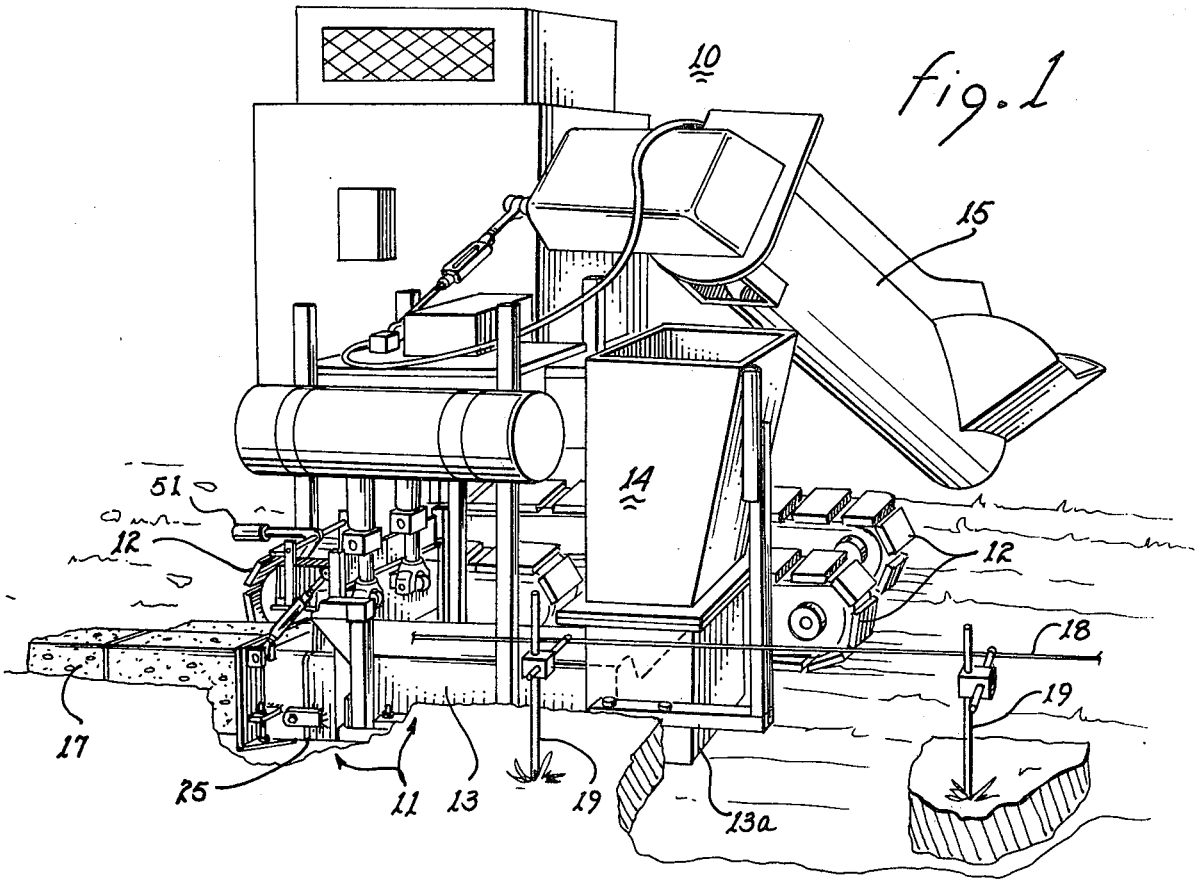
FIG. 1 is an outline view of a machine according to the invention showing the curbing at the left side.
Figure 2:
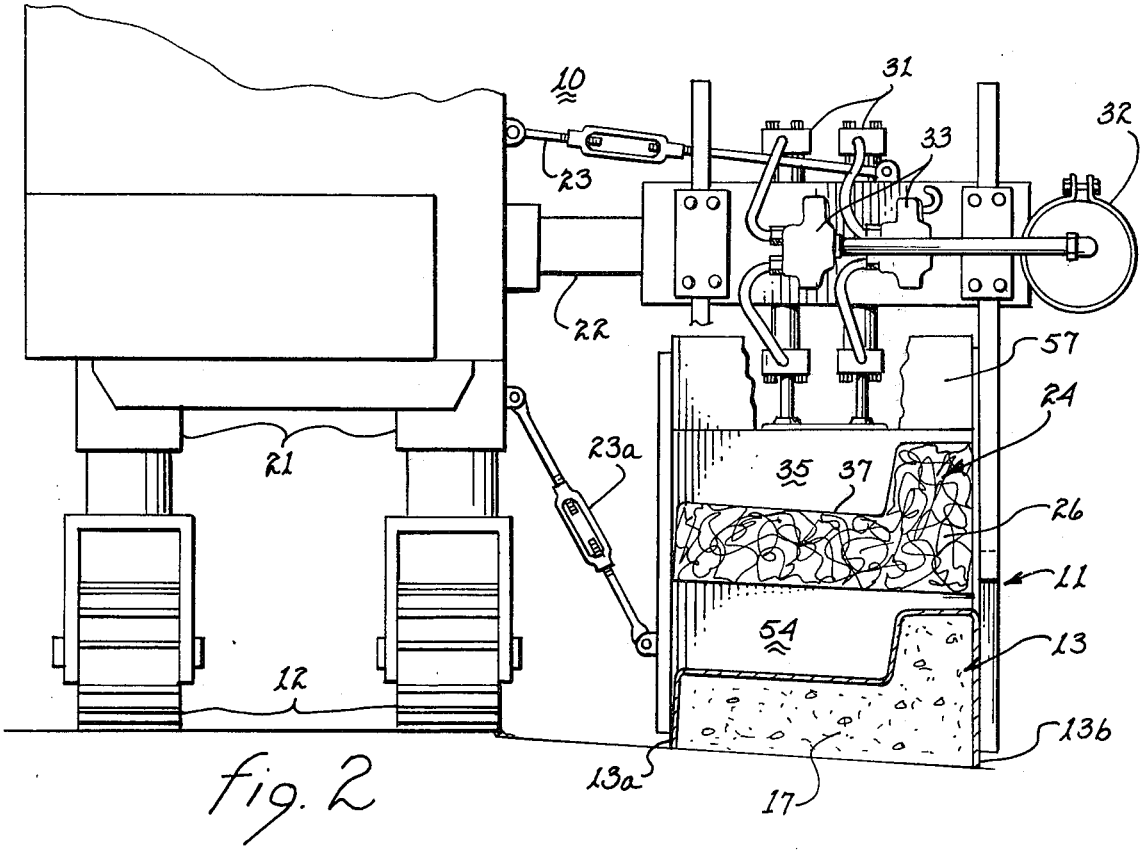
FIG. 2 is a partial end view of the machine shown in FIG. 1.

Referring to the drawings, there is shown a continuous curb laying machine 10 embodying the expansion joint inserting mechanism and method of the invention shown generally by the reference character 11 in FIGS. 1 and 2.

The machine 10 moves in the direction of the arrow A under the influence of power-driven caterpillar treads 12. In so doing, the machine deposits pre-mixed concrete underneath a slip form 13, referred to in the trade as a mule, from a hopper 14 into which the concrete has been deposited from a spiral conveyor 15 to which the green concrete is supplied through a chute 16 by any concrete mix vehicle (not shown, but as is well understood in this art).

As the machine 10 moves forwardly in the direction of the arrow A, the curb 17 is formed by taking the shape of the undersurface of the mule, or slip form 13, which is in the shape of the curb, or conforms to it. In a sense, the shape of the mule, or slip form, is the reversed image of the curb itself. The machine is guided very accurately along a line determined by a guide line 18 disposed in the proper location and held by supports 19 as is well understood and which form no part of the present invention.

The machine 10 moves forwardly under power supplied from any convenient engine aboard such as, for example, diesel engines that are not shown and do not form part of the invention. The machine, however, can be accurately controlled to move forwardly at a steady pace so that the curbing 17 is laid down at a uniform rate and with uniform quality.

Referring to FIG. 2, two of the caterpillar treads 12 are shown as well as support members 21 resting thereon. It is understood that the remaining portion of the machine 10 would be disposed atop that portion shown in FIG. 2, but the detail of the machine is not necessary to the explanation of the invention and it is not shown in FIG. 2. Nevertheless, attached to the support, or frame work, 21 is an appropriate arm 22 and links 23 and 23A which support the curb laying apparatus 11 including the slip form or mule 13 and the green concrete supply mechanism including the hopper 14, the conveyor 15, the chute 16 and the expansion joint inserting blade mechanism 24.

The machine 10 moves at a relatively slow rate, the length of the mule 13 between the point where the concrete is fed into it at chute 14 and the exit end of the machine at a point defined by the reference character 25 (slightly beyond the blade inserting mechanism 24), being such that the curb will retain its desired shape as seen at the reference character 17, for example. For this to occur, the concrete has to be of the relatively quick set variety.

However, while the concrete has assumed its final shape and retains it, the concrete is still green so that the inserter blade and the expansion joint felt material can be rammed into it as will be described.

Referring more particularly to FIGS. 3–6, there is shown in fragmentary form the inserting blade machanism 24 and a piece 26 of expansion joint material, or felt. The finished curb 17 also is shown with a piece of curb expansion joint material 26 in place therein after having been rammed there into by the mechanism to be described.

The expansion joint inserting mechanism 24 includes a blade 27 disposed to move and guides 28. The blade is driveable downwardly and upwardly by means of connecting rods 29 driven by air cylinders 31 supplied from a tank 32 of air under pressure through appropriately operating air valves 33 which may be electrically controlled, as is well understood. All of the apparatus described for actuating the blade 27 is, of course, supported by the arm 22, the links 23 and 23A and any necessary other mechanism not shown, as is well understood.

A slot 34 (FIG. 3) is disposed between the forward and rearward portions of the mule 13 and provides a space for movement, downwardly and upwardly, of the blade 27.

Attached to the rearward, or downstream, side of the blade 27 by any suitable means such as, for example, welding, is a template, or inserting plate, 35 which has a shape conforming to that of the curb. Thus, it is adapted to receive the piece 26 of expansion joint material as may be visualized more clearly in FIGS. 2 and 4. The edge 36 of the felt piece 26 conforms to and interfits with the edge 37 of the template 35. The expansion joint piece 26 is of such dimensions as to be readily disposed along the edge 37 of the template 35 and is disposed between the facing edges of the guides 28. The blade 27 can move downwardly in the slots 28A of the guides 28 without any interference from the expansion piece. The blade 27 has a lower edge 38 that may be sharpened as shown for easier insertion into the concrete surface and thus to enable the dislodgement in the concrete mass of any rocks, gravel or the like.

When the expansion joint piece 26 is placed into position against the blade 27, the lower edge 39 thereof preferably is disposed slightly above the sharpened lower edge 38 of the blade 27. Thus, when the blade 27 is rammed downwardly the edge 28 can start a groove or kerf the continuation of which, as the blade 27 moves downwardly, enables the expansion joint piece 26 to move into the groove thus formed, thereby disposing the expansion joint piece into the resulting kerf in the partially cured concrete. When the blade 27 is retracted the expansion joint piece 26 remains in place, being held there by friction with concrete. The placement of the pieces 26 and the operation of this structure will be described more fully.

In operation of the machine 10, the machine moves forwardly in the direction of the arrow A at a specified velocity which might be, for example, ten to twenty-five feet per minute, and is continuous on the prepared roadway surface. During this movement, the concrete is supplied to the chute 14 and thus to the mule, or slip form, 13 from the conveying apparatus described and the concrete curbing is formed by the extrusion of the concrete into the slip form. At the appropriate places indicated by markers on the edge of the roadway surface, for example, or otherwise, without stopping the machine the air pressure is supplied, through suitable valves, to the cylinders 31 thereby ramming the blade 27 downwardly through the slot 34 as may be seen in FIG. 3, a piece of expansion joint felt 26 previously having been placed in position against the template 35. Thus as the blade 27 moves downwardly in the guillotine like slots 28A in the guides 28 the expansion joint piece 26 is forced into, or rammed into, the green concrete. As indicated, when the blade 27 is retracted by the reverse movement of the connecting rods 29, the expansion joint piece 26 remains in place. As may be seen in FIG. 3, the expansion joint piece 26 is in place between two adjacent sections of the concrete curbing and the curbing retains its shape. The distance of the slot 34 from the end 13A of the mule in a typical case may be about six feet.

With the insertion of the expansion joint piece 26 as described it has been found that the resulting joint is smooth and does not need any patching to provide an appropriate finished appearance. In other words, the ramming into the concrete of the expansion joint piece does not mar the surface of the curb in any significant way.

The expansion joint piece 26 may have any desired thickness, for example, three-eighths to one-half inch and is a relatively rigid piece of material in order to perform the function of being an expansion joint. This stiffness renders it adequate for ramming it through the concrete curb in the setting process.

As has been indicated the sharpened edge 38 enables the blade 27 to move into the concrete relatively easily, but the sharpened edge on the upstream side moves away any pebbles or gravel that tend to block the downward movement of the blade.

In the operation of the device it has been found that the cylinders 31 may be typical four inch by seventeen inch devices operating on an air pressure of about one hundred pounds per square inch.

Additional structure of the invention may now be described: Following the exit 25 of the slip form proper 13 (mule) just beyond the slot 34, the slip form terminates in a nose member 41 of the same cross-sectional shape as the mule. Such a nose member is sometimes referred to in the trade as a fresno. For any adjustability as may be necessary, the nose member 41 (fresno) is pivotally attached by a bolt 42, for example, which passes through an opening in a bracket 43 welded to the end of slip form 13. While not shown, there would be, ordinarily, two brackets 43, one on each side of the nose member 41. In addition, the upper portion of nose member 41 is attached by means of turn buckle links 44 to the vertical members 28. The adjustability provided by the links 44 enables the nose member 41 to assume the same line as that of the slip form. In addition, the presence of the nose member 41 provides any additional smoothing of the cast concrete with the expansion material 26 inserted therein as may be needed as a result of the ramming into the concrete of the inserting blade and the insertion joint material.

Figure 5:
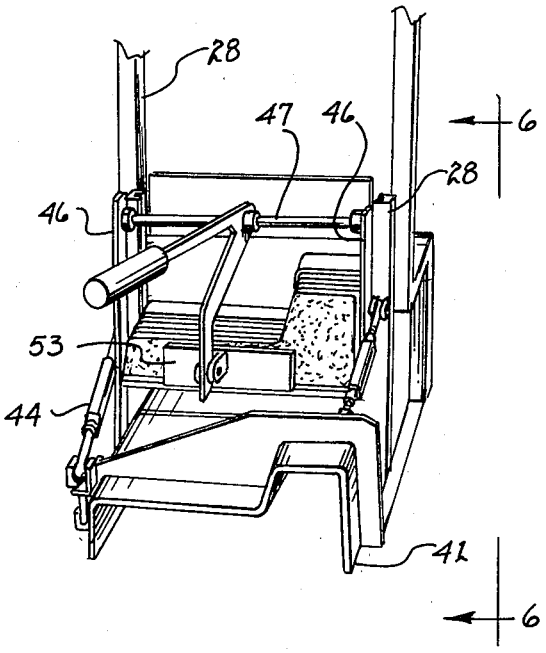
FIG. 5 is a fragmentary end view, in perspective, of the machine shown in FIGS. 1 and 2.
Figure 6:
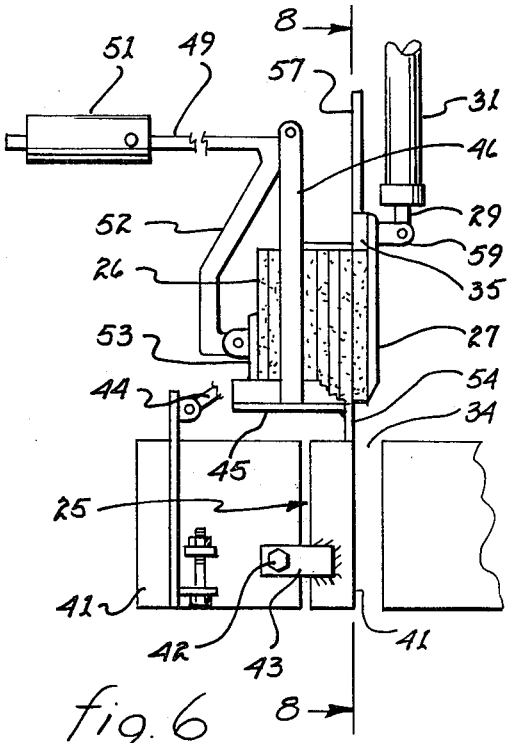
FIG. 6 is a side view taken in the direction of the arrows 6—6 of FIG. 5.
Figure 7:
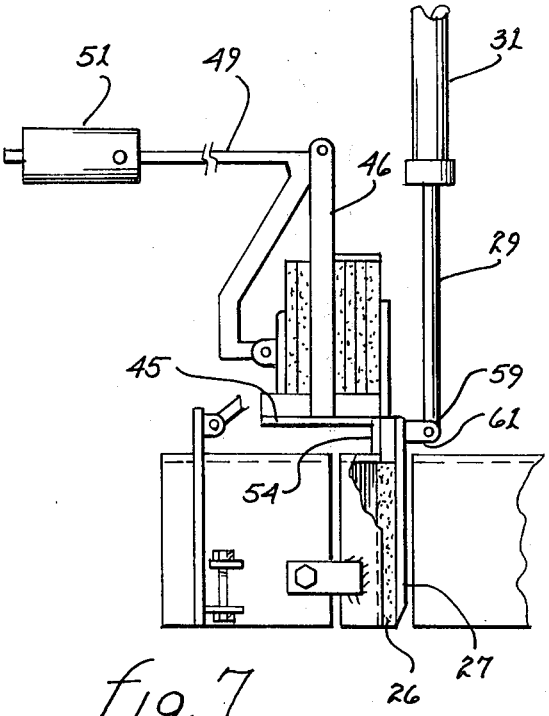
FIG. 7 is a view similar to FIG. 6 with certain parts in a different operating position.

An inventory of expansion joint pieces 26 is provided as shown in FIGS. 5, 6 and 7 along with certain additional structure. As shown in these Figures the inventory of expansion joint pieces 26 is held on a tray 45 which is welded to the upright members 28. Welded, for example, to the ends of tray 45 is a pair of upright members 46 between which extends a shaft 47. Midway between the uprights 46 on shaft 47 there is a lever 48, one arm 49 of which is adapted to support a weight 51 and the other arm 52 of which bears against a plate 53, which in turn bears against the outermost of the pieces 26. As may be understood from FIGS. 5, 6 and 7, the weight 51 urges the insertion pieces 26 inwardly to be received, at the appropriate time, against the blade member 27.

Between the base of the tray 45 and the upper surface of the rearward end of the slip form 13 is a guide plate 54. The lower edge 55 of the guide plate conforms to and bears against the cooperating surface of the slip form 13 and may be welded thereto. The upper edge 56 of the guide plate 54 extends relatively straight across and, as indicated above, is welded to the lower surface of the tray 45 and forms therewith the surface along which the insertion members 26 are moved into position. The interior surface of the guide plate 54 adjacent the slots 34 conforms to the line 41A of the nose member 41 to form an in line director for the movement of the expansion joint piece 26 as may be visualized by comparing FIGS. 6 and 7. Thus, as the expansion piece 26 is being moved downwardly, the body thereof is squeezed between the interior surface of the guide plate 54 and the adjacent surface of the blade 27 to compress the expansion material as it moves into the green concrete. When all of the piece 26 has been inserted (FIG. 7), its fibrous nature causes it to expand due to the release of the compression it has gone through. Hence, the material thereupon expands underneath the surface of the guide plate and the slip form and does not have as great a tendency to be retracted along with the blade 27 on its retractive stroke.

Disposed atop the straight upper edge 35A of the template 35 is a stop plate 57 which may be welded to the cooperating edge of the template. As the template 35 moves downwardly, as can be seen in comparing FIGS. 5 and 7, the next adjacent insertion member 26 will tend to be moved into position by the action of weight 51 and the associated mechanism. The stop plate 57, however, moves into position inasmuch as this member is directly in line above the template 35 and consequently, the next in line insertion member 26 moves only until it is up against the stop plate 57 at which point it stops its movement. When, however, the inserting blade 27 has moved to its upper position as shown in FIG. 6 the stop plate 57 has moved out of the way and the next in line insertion member 26 moves into position for the coming insertion stroke. Closing the upper portion of the tray 45 is a top member 58 which lies just above the inventory of expansion members 26 and thus prevents these members from moving upwardly out of position when the blade 26 is moved in its upward stroke.

Figure 8:
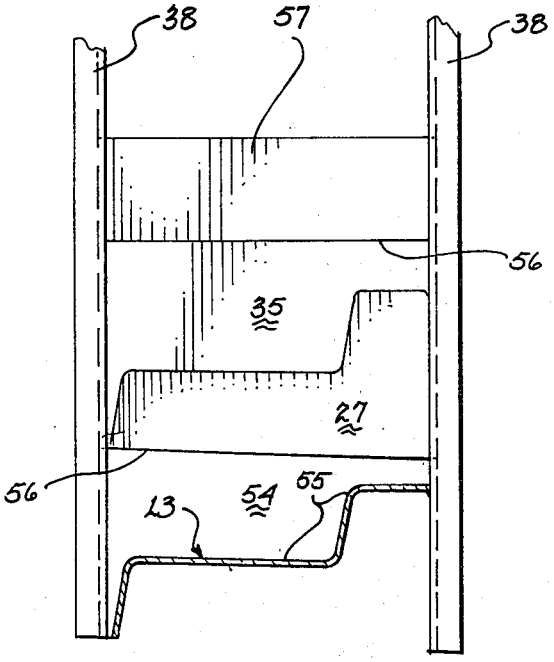
FIG. 8 is a fragmentary diagrammatic front view of certain operating parts taken along the lines 8—8 of FIG. 6.

In FIG. 8 the relative positions of the operating members may be visualized before the insertion stroke has taken place, which is to say the view would be taken in the direction of lines 8—8 of FIG. 6. Thus in FIG. 8, there may be visualized the slip form 13 in sectional view, the guide plate 54, the insertion blade 13, the blade 27, the insertion member, or template, 35 and the stop plate 57 all arranged for the moving parts to move downwardly in the vertical guides 38. The corresponding view to FIG. 8 for the parts as shown in FIG. 7 would differ essentially only in that the blade 13 and the template 35 would exist in the downward or lowermost position.

It will be noted that the connecting rods 29 of the operating cylinders 31 are connected to the inserting blade 27 by pivotal connections 59 to relatively short arms 61 extending forwardly of the inserting blade. The length of the arms 61 forms a lever arm separating the blade 27 from the line of travel of the rods 29 so that as the rods 29 move down the blade 27 is tended to pivot clockwise as may be visualized best in FIG. 7. This clockwise tendency of the blade 27 tends to urge the expansion piece 26 clockwise which is to say against the concrete mass into which it is being inserted. This causes the piece 26 to be compressed against the mass of concrete. Hence, when the rods 29 move upwardly to retract the blade 27, the same lever arm 61 tends to pivot the blade 27 counter-clockwise which is to say away from adjacent surface of the expansion joint piece 26. Accordingly, the piece 26 tends to be released from the blade 27 and tends to remain, and in fact does remain, securely within the slot formed in the green concrete. Thus, in addition to the fact that the expansion piece 26 is first compressed and expands under the surface of the slip form, the blade 27 is rotated away from the expansion piece. The two effects combine to avoid removal of the expansion joint piece 26.

Figure 3:
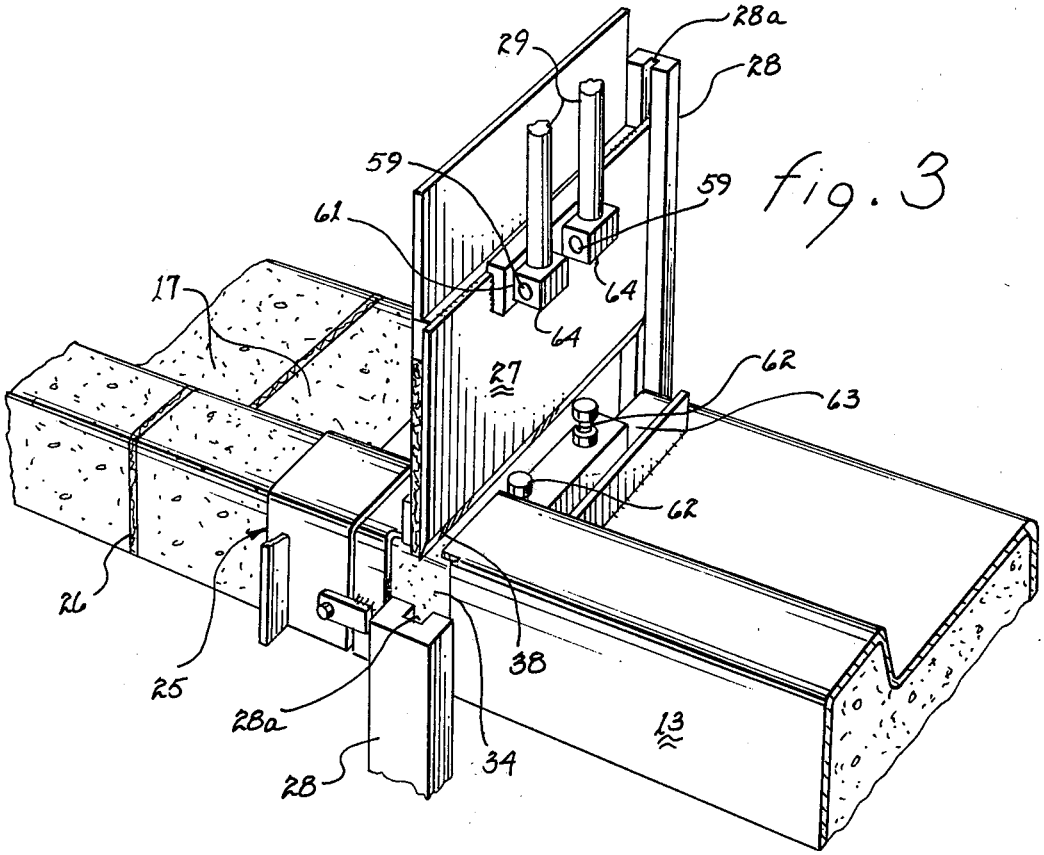
FIG. 3 is a fragmentary view, in perspective, of certain operating components in operating position.
Figure 4:
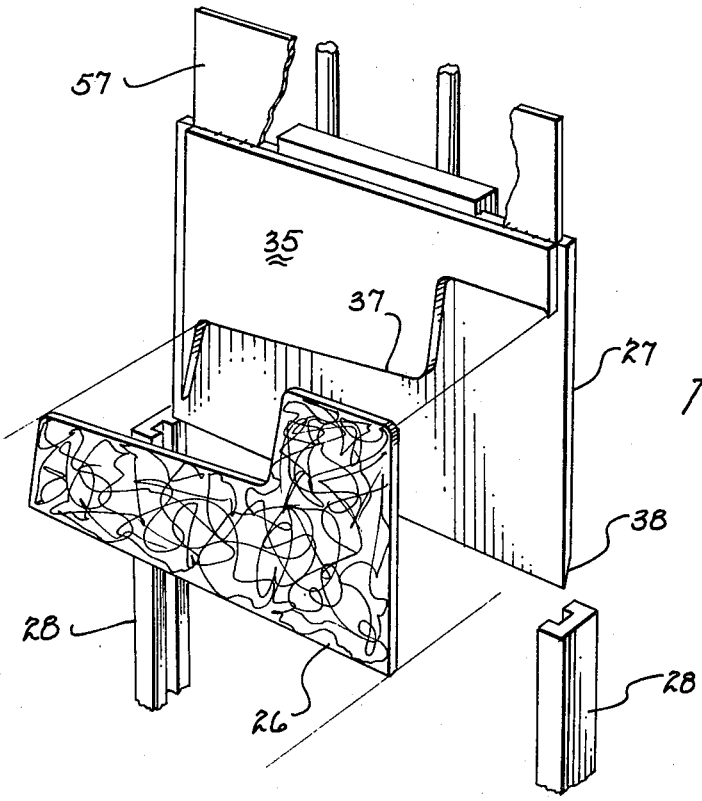
FIG. 4 is a fragmentary view, from a different perspective, of some of the components shown in FIG. 3.

Referring to FIG. 3, there are shown two screw type stops 62 disposed in a cross-member 63 supported on, and attached to, the forward edge of the slip form. The stops 62 are adjusted to abut against the blocks 64 which hold the pivots 59. In this manner the extent of the downward travel of the blade 27 is adjusted to the desired value.

The rods 29 are caused to move upwardly by appropriate action of the valve to admit air into the cylinders 31 as is well understood. The valves may be controlled electrically or mechanically as desired without involving the present invention.

As may be seen in the Figures, the left side 13A of the slip form is higher than the right side 133. This is to conform the shape of curb 17 to the road surface which ordinarily has a crown, or slight angularity.

While one form of apparatus and method are shown, it will be clear that other forms may be devised without departing from the scope of the disclosure.

I claim:

1. The apparatus for inserting pieces of expansion joint material into a curb strip of green cast concrete curbing comprising a slip form of predetermined length and curb shape underneath which concrete is to be cast, a slot in said slip form, blade means adapted to move through said slot perpendicularly to the line of said slip form and through any cast concrete curbing, a template attached to one side of said blade for movement therewith, said template having a pushing surface whose outline is the conforming image of the curb surface shape, means for moving said blade into and out of the slot in said slip form, means for pivoting said blade means clockwise on the insertion stroke and counter-clockwise on the retraction stroke and means for storing and feeding pieces of said expansion joint material.

2. Apparatus for inserting a piece of expansion joint material into a curb strip of green cast concrete comprising a slip form of predetermined length and curb shape underneath which concrete is to be cast, a slot in said slip form, blade means adapted to move through said slot perpendicularly to the line of said slip form and through any cast concrete curbing, a template attached to one side of said blade for movement therewith, said template having a pushing surface whose outline is the conforming image of the curb surface shape, means for moving said blade into and out of the slot in said slip form, and means for pivoting said blade means clockwise on the insertion stroke and counter-clockwise on the retraction stroke.

3. The apparatus for inserting a piece of expansion joint material according to claim 2 wherein the means for moving said blade into and out the slot in the slip form comprises fluid pressure actuated pistons.

4. The apparatus for inserting a piece of expansion joint material into a curb strip of cast concrete according to claim 2 wherein the template pushing surface is on the downstream side of said blade.

5. The apparatus for inserting a piece of expansion joint material into a curb strip of cast concrete according to claim 4 wherein said blade has a sharpened edge on its upstream side.

* * * * *